US008931975B2

(12) United States Patent
Warlow et al.

(10) Patent No.: US 8,931,975 B2
(45) Date of Patent: Jan. 13, 2015

(54) MOBILE ASPHALT CONCRETE PRODUCTION MACHINE

(75) Inventors: Jerry L. Warlow, Lebanon, PA (US); David E. Pierce, Lebanon, PA (US); Boris Fridman, York, PA (US)

(73) Assignee: Hot Mix Mobile, LLC, Lebanon, PA (US)

( * ) Notice: Subject to any disclaimer, the term of this patent is extended or adjusted under 35 U.S.C. 154(b) by 433 days.

(21) Appl. No.: 13/153,966

(22) Filed: Jun. 6, 2011

(65) Prior Publication Data

US 2013/0058719 A1 Mar. 7, 2013

(51) Int. Cl.

| | |
|---|---|
| ***E01C 23/14*** | (2006.01) |
| ***E01C 19/02*** | (2006.01) |
| ***E01C 19/45*** | (2006.01) |
| ***B01F 13/10*** | (2006.01) |
| ***B01F 7/00*** | (2006.01) |
| ***B01F 7/08*** | (2006.01) |
| ***B01F 15/02*** | (2006.01) |
| ***B01F 15/06*** | (2006.01) |
| ***E01C 19/08*** | (2006.01) |
| ***E01C 19/10*** | (2006.01) |

(52) U.S. Cl.

CPC ..... *B01F 13/1055* (2013.01); *B01F 7/00433* (2013.01); *B01F 7/00641* (2013.01); *B01F 7/00708* (2013.01); *B01F 7/086* (2013.01); *B01F 15/0231* (2013.01); *B01F 15/063* (2013.01); *E01C 19/08* (2013.01); *E01C 19/104* (2013.01); *B01F 2015/062* (2013.01)

USPC ..... 404/92; 404/95; 404/108; 404/110

(58) Field of Classification Search

USPC ..... 404/90, 91, 95, 101, 108, 110, 111, 92

See application file for complete search history.

(56) References Cited

U.S. PATENT DOCUMENTS

| | | | |
|---|---|---|---|
| 1,468,365 | A | 9/1923 | Johnston |
| 1,574,489 | A | 2/1926 | Kittel |
| 1,620,952 | A | 3/1927 | Davies |

(Continued)

FOREIGN PATENT DOCUMENTS

| | | | |
|---|---|---|---|
| JP | 2004122051 | A | 4/2004 |
| WO | 2008103035 | A1 | 8/2008 |

OTHER PUBLICATIONS

Korean Intellectual Property Office; The International Search Report and the Written Opinion of the International Searching Authority, or the Declaration; International Search and Written Opinion; Feb. 18, 2013, pp. 1-13; Korean Intellectual Property Office; Korea.

*Primary Examiner* — Gary Hartmann

(74) *Attorney, Agent, or Firm* — Middleton Reutlinger; John F. Salazar; Chad D. Bruggeman

(57) ABSTRACT

A mobile asphalt production machine which includes support for different asphalt concrete recipes including a plurality of aggregate storage bins which work on combination with a fines or sands storage bin. The individual bins have separated feeding chutes to the mixing trough. The machinery also includes a removable pan at the elevator transfer station to accommodate changeover from one grade aggregate material to another. Further, a controller is provided which delivers appropriate ingredients while also measuring process parameters to adjust various input requirements. Further, a dust and particulate recapturing system is provided which recycles particulate matter back into the ribbon of mixed material with a binding agent.

18 Claims, 10 Drawing Sheets

(56) References Cited

U.S. PATENT DOCUMENTS

| | | | | | |
|---|---|---|---|---|---|
| 2,041,359 | A | | 5/1936 | Littleford, Jr. | |
| 2,548,177 | A | | 4/1951 | Tauber | |
| 2,773,496 | A | | 12/1956 | Czarnecki | |
| 2,867,421 | A | | 1/1959 | Camm | |
| 2,916,262 | A | | 12/1959 | Flores | |
| 3,180,630 | A | | 4/1965 | Endres et al. | |
| 3,227,055 | A | | 1/1966 | Glade | |
| 3,362,399 | A | | 1/1968 | Lindenfeld | |
| 3,537,443 | A | | 11/1970 | Becker | |
| 3,633,563 | A | | 1/1972 | Osborn | |
| 3,721,226 | A | | 3/1973 | Childree et al. | |
| 4,272,212 | A | * | 6/1981 | Bauer et al. | 404/72 |
| 4,307,705 | A | | 12/1981 | Douglas | |
| 4,453,856 | A | * | 6/1984 | Chiostri et al. | 404/91 |
| 4,505,669 | A | | 3/1985 | Rogers | |
| 4,623,279 | A | | 11/1986 | Smith | |
| 4,641,764 | A | | 2/1987 | Faulkner, III | |
| 4,708,519 | A | | 11/1987 | Davin et al. | |
| 5,035,534 | A | * | 7/1991 | Brock et al. | 404/81 |
| 5,333,600 | A | | 8/1994 | Fitzpatrick | |
| 5,378,079 | A | * | 1/1995 | Omann | 404/75 |
| 5,385,426 | A | * | 1/1995 | Omann | 404/75 |
| 5,386,947 | A | * | 2/1995 | Omann | 241/41 |
| 5,451,003 | A | * | 9/1995 | Omann | 241/18 |
| 5,657,904 | A | | 8/1997 | Frates et al. | |
| 5,718,220 | A | | 2/1998 | Onken | |
| 5,853,243 | A | | 12/1998 | Duggan et al. | |
| 6,007,419 | A | | 12/1999 | Bessire | |
| 6,056,429 | A | | 5/2000 | Duggan et al. | |
| 6,109,826 | A | * | 8/2000 | Mertes | 404/95 |
| 6,186,700 | B1 | * | 2/2001 | Omann | 404/79 |
| 6,439,806 | B1 | | 8/2002 | Dillingham | |
| 7,458,746 | B1 | | 12/2008 | Zimmerman | |
| 7,626,143 | B2 | | 12/2009 | Miller | |
| 7,654,772 | B1 | | 2/2010 | Zimmerman | |
| 8,342,773 | B2 | * | 1/2013 | Kropacek | 404/92 |
| 8,382,362 | B2 | * | 2/2013 | Omann | 366/7 |
| 8,579,543 | B2 | * | 11/2013 | Ma | 404/95 |
| 8,662,789 | B2 | * | 3/2014 | Ma | 404/77 |
| 2006/0280026 | A1 | | 12/2006 | Dackefjord | |

* cited by examiner

MOBILE ASPHALT CONCRETE PRODUCTION MACHINE

TECHNICAL FIELD

The present invention is directed towards a mobile asphalt concrete production machine which has the capability of manufacturing various forms of asphalt concrete utilizing different recipes and varying quantities of multiple grades of aggregate and fines to generate asphalt concrete on location.

BACKGROUND

Asphalt concrete production has typically been conducted at permanent locations or facilities. These permanent locations or facilities require transport of the high temperature asphalt concrete from the production plant to installation locations which can be significant distances from the plant. Transportation of high temperature asphalt concrete over the open road produces significant problems in production, logistics and installation of the asphalt concrete. These difficulties include loss of heat, increased requirement of heat for transportation time periods, multiple trips to transport various asphalt concrete recipes necessary for roadway surfaces, as well as many other known issues.

Other issues in regards to permanent or fixed location asphalt concrete production facilities include heightened costs for small jobs requiring smaller volumes and multiple trips for differing grades of asphalt concrete. As a result, in small paving projects, a single grade of asphalt concrete will be delivered and utilized for the entire project as opposed to appropriate multi-layer asphalt concrete typically utilized when building roadway surfaces.

In building roadway surfaces, a base course must be first laid which normally requires larger aggregate having certain desirable properties. This larger aggregate in the base course can be three-quarter inch aggregate base in order to create the base course pavement utilized in the sublayer material of an asphalt roadway.

On top of the base course may be placed a wearing surface which utilizes finer quality of rock and aggregate, possibly in the range of one-quarter to one-half inch aggregate or less. Combinations of both the base course and the wearing surface thus increase the life of the asphalt roadway.

It has been proposed to provide a mobile asphalt production machine which may mix bituminous concrete at the job site utilizing an auger mixing mechanism. However these asphalt mixing machines have known production problems in making the various asphalt concrete recipes. Such drawbacks include the inability to create multiple grades of asphalt concrete while also not allowing for corresponding variations in the size of aggregate during the production process. These deficiencies make prior art asphalt production machines ineffective and inappropriate for mobile use to create varying asphalt concrete recipes which require the use of different sizes of fines, aggregate and other elements. It would thus be desirable to be able to produce multiple grades of asphalt concrete on location and on a mobile platform without the necessity of transporting the various grades of asphalt concrete from a permanent or fixed location production facility.

Thus, there is a need in the art to provide an asphalt concrete production machine which is both mobile and which accommodates recipe changes for various asphalt concrete quality and recipes thereby requiring different constituent ingredients. This need in the art is necessary to overcome one or more of the drawbacks associated with the asphalt concrete production machines known in the art.

SUMMARY

The present disclosure is directed to an inventive method and apparatus for a mobile asphalt concrete production machine which accommodates multiple grades of constituent aggregate ingredients for an asphalt concrete recipe. For example, the mobile asphalt concrete production machine may include multiple aggregate storage bins for various sized aggregate material to be combined with fines material in the production process. Accommodation may be made for incorporating the materials from the individual bins in a mutually exclusive fashion to be combined with the fines bin material at a mixing station where the combined material may be introduced to a binding agent such as liquid bitumen. The mobile asphalt concrete production machine may include a separate mixing system which adjusts for the various size aggregate materials included for the particular recipe and production of specified type of asphalt concrete. Various implementations of the mobile asphalt concrete production machine set forth herein may include the ability to quickly change over from various storage bins while preventing mixing of the various size aggregate materials contained on the machine. Other aspects may include vertical adjustability of the mixing auger as well as adjustments to the mixing process in order to take into account the size of the aggregate material, residence time required, temperature and pressure, among other things.

Generally, in one aspect, a truck may be provided with multiple components combined to create asphalt concrete from various ingredients. The multiple components may include a plurality of aggregate storage bins combined with a fines storage bin all of which dispense material into a mixing trough, the plurality of aggregate storage bins dispensing aggregate individually or as needed by the asphalt concrete recipe. A controller may be provided in order to properly dispense aggregate material in combination with the fines or sand material into the appropriate mixing station. Controllers may also be provided with programming in order to modify the residence time of the aggregate and fines material with the amount of liquid bitumen to be provided in the mixing chamber based upon the recipe of asphalt concrete desired.

In some embodiments, the mixing auger may float within the mixing chamber in order to accommodate multiple diameter aggregate materials dispensed within the mixing chamber. The mixing trough may also float within the supports to expand and contract without negatively affecting fixed joints between the trough and the support system.

In further embodiments, change over from recipes requiring a first aggregate material to a second aggregate material may be expedited based upon a conveyor/elevator transfer station which has a removable drawer, the removable drawer being the dispensing location of the aggregate material which is mixed with the fines material.

In some embodiments disclosed herein, the mobile asphalt concrete production machine may include a floating mixing trough which allows for expansion caused by high heating temperatures within the mixing trough during the production cycle.

In some embodiments, the mobile asphalt concrete production machine includes both a first and second aggregate storage bin which is combined with a fines storage bin on a flat bed truck or other mobile device. A programmable logic controller may be utilized in order to control dispensing of the individual aggregate required for the desired recipe of asphalt concrete. The selected aggregate may then be combined with the appropriate amount of fines or sand ingredient element to be conveyed to a mixing trough, the mixing trough alternatively including multiple liquid bitumen injection stations and a mixing auger to properly and appropriately mix and retain the material until the asphalt concrete is properly and uniformly created.

In other embodiments, the mixing auger may include the ability to float within the mixing trough so as to accommodate various diameter aggregate materials dispensed into the mixing trough with the fines material.

In still other embodiments, the mixing station may include a first and a second mixing auger portion so that proper rotational and adjustability of the augers to accommodate various diameter aggregate materials dispensed within the mixing trough may be completed.

In still further embodiments, a mobile asphalt concrete mixing machine may be implemented using a programmable logic controller which controls the dispensing speed of the individual aggregate materials into the conveyor and elevator transfer area, the controller also maintaining the dispensing speed of the fines material to be mixed therewith. The controller may further operably control the amount of heat introduced in the mixing trough, as well as the amount of liquid bitumen to be mixed with the constituent materials. Such controller in many embodiments may further control the rotation speed of the auger in order to properly determine the residence time of the constituent elements within the mixing trough to insure the least amount of liquid bitumen is utilized in the mixing process while also creating the appropriate grade of asphalt concrete and maintaining the needed environmental conditions for proper mixing.

In some embodiments, a conveyor/elevator transfer station may be placed at the end of a plurality of conveyor chutes, the ends of each of the chutes having operable dispensing gates at the transfer station. The plurality of conveyor chutes may match the plurality of storage bins having discharge apertures, the bins positioned on the mobile asphalt production truck.

In still further embodiments, the conveyor/elevator transfer station may include a removable drawer, the removable drawer allowing the operator of the mobile asphalt concrete production machine to change from a first recipe requiring a first aggregate over to a second recipe requiring a second aggregate by removing the undesirable sized aggregate for the requested recipe from the transfer station.

In still further embodiments, dust and other particulate material caused by the mixing of the fines and aggregate within the mixing trough may be reduced by providing and combining a baffle system with a air flow fan in the mixing trough, the air flow fan drawing in dust and other particulates from a first portion of the mixing trough into a second portion of the mixing trough, the dust and other particulates being dampened by liquid bitumen in the second portion of the mixing trough and returned and remixed into the asphalt concrete.

Additional aspects may include a mixing auger which incorporates a plurality of flights, the flights extending longitudinally along the mixing auger may be provided to disrupt the ribbon of material formed within the mixing trough so that all of the aggregate and other ingredients of the asphalt concrete are disrupted, lifted and continually mixed with the heat and liquid bitumen being injected into the mixing trough.

In still further aspects and embodiments described herein, the plurality of longitudinally extending flights may be L-shaped, curved or flat, the L-shaped flights acting as a scoop or cups to disrupt, lift and separate portions of the material being mixed within the mixing trough so that these lifters, which may run parallel to the longitudinal axis of the auger and between auger flights. These also act to interrupt normal auger advancement of the material within the mixing trough.

In some embodiments, dust may be kept to a minimum within the mixing trough by inclusion of a baffle plate interior to the mixing trough; the baffle plate may optionally include a pass through baffle flange for the material to pass underneath while separating the dust and other particulate material.

In various embodiments, the mobile asphalt concrete production machine includes at least three or more storage bins, the dispensing of which is fully controlled by the controller.

Still further embodiments include a floating mixing trough and support system which allows the mixing trough, which undergoes extensive heating and cooling cycles, to float free and prevent damage to welds and other permanently affixed mechanisms which attach the t rough to supporting structure.

It should be appreciated that all combinations of the foregoing concepts described herein within the entire specification, as well as additional concepts discussed in greater detail (provided such concepts are not mutually inconsistent) are contemplated as being part of the inventive subject matter being disclosed herein. In particular, all combinations of claimed subject matter appearing at the end of this disclosure are contemplated as being part of the inventive subject matter described and claimed herein. It should also be appreciated the terminology explicitly employed herein that may also appear in any disclosure incorporated by reference should be accorded a meeting most consistent with the particular concepts and definitions set forth.

A BRIEF DESCRIPTION OF THE DRAWINGS

In the drawings, like reference characters generally referred to the same parts throughout the different views. Also, the drawings are not necessarily to scale, emphasis instead generally being placed upon illustrating the principals of the invention.

DETAILED DESCRIPTION

Figure 1:
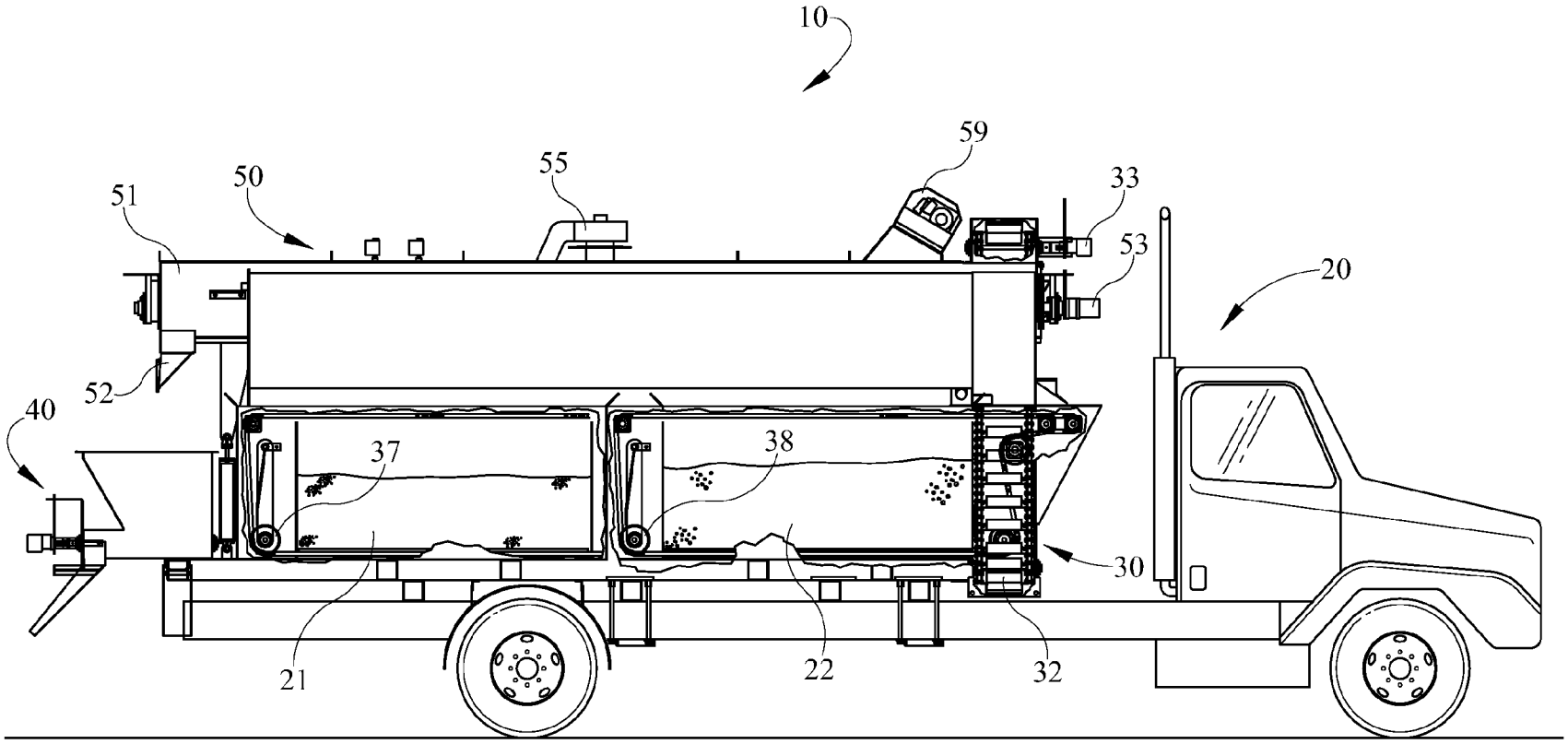
FIG. 1 illustrates a side view of the mobile asphalt concrete production machine having multiple aggregate bins and accommodating multiple size aggregate material in the mixing process.

The system described herein incorporates the utilization of multiple aggregate bins for creation of variant layers and quality of asphalt. Both fines and course aggregate may be fed and various bins supported on the mobile trailer to a mixing auger system. A plurality of bins are provided to provide support, in one embodiment, for both ¾ inch size aggregate and ⅜ inch size aggregate to be combined in varying degrees with the sands or fines material, all of which are separated and kept in position on the mobile support device for feeding depending upon the particular recipe selected. Each individual bin of the plurality of bins supported has their own conveyance system. In one embodiment, individual conveyors or drag chains may draw aggregate and sand material forward to an elevator system which will transport the component materials to the mixing auger.

In other embodiments, conveyor systems may be utilized to transport materials to the mixing auger. In various embodiments, both fine and course aggregate material may be mixed with the sand in order to provide both a lower layer rough asphalt base course and upper layer fine or wearing surface, depending upon the particular recipe and mixture component materials required.

In one embodiment, the individual conveyors draw forward the separate aggregate component elements, each of the conveyors independently controllable and driven by the PLC. Various mixture recipes may call for fine, course or a combination of fine and course aggregate to be combined with the sand in the mixing auger.

The individual bins for the fine aggregate, course aggregate and sand are readily accessible from the exterior of the mobile system and may be refilled as necessary.

In further embodiments, the multiple conveyors which are fed at openings of the individual storage bins conveying material forward through a collection point thereby feeding a plurality of risers on an elevator system, each of the individual risers elevating the material from the lower collection area to the mixing auger for combination, mixing and spraying with the high temperature bitumen. The speed of the individual conveyors and elevator may be timed appropriately with the mixing auger and pump for the bitumen such that a PLC controls the individual component elements for the particular recipe selected by the operator at the PLC.

In the lower portion of each individual storage bins are openings or discharge apertures for feeding each of the conveyor systems. In some embodiments, the conveyor system may be combined. In other embodiments, individual and separated conveyors may be utilized in order to assure properly measured material is fed to the elevator system and into the mixing auger.

Support for multiple component aggregate materials is provided by individually providing separate aggregate bins through which the PLC may selectively acquire aggregate component elements for the recipe selected by the user at the PLC. Speed control, selection and mixing times all may be programmed into the PLC for proper residence time of the ribbon of material within the mixing auger in order to create the appropriate asphalt conditions. Thus, in various embodiments depicted, both course and fine asphalt for a base course and wearing surface material may be mixed at a single location without the necessity of running multiple batches from a remote location.

A mixing auger is provided within a trough in order to properly blend the aggregate and sand components with the hot liquid bitumen pumped into the mixing chamber. Within the mixing chamber is positioned an auger for rotation therein and proper mixing of the recipe component elements. In one embodiment, the mixing auger may have a plurality of flights helically surrounding a central axis. Depending upon the length of the mixing trough and chamber, a first and a second mixing auger may be provided connected at a central bearing support. The central bearing support is positioned between the two mixing augers and may allow for flexing in a longitudinal direction between the first and second auger.

In other embodiments, a single auger may be utilized longitudinally extending throughout the entire mixing chamber.

In still further embodiments, the mixing auger may have a plurality of flights inter-connected with longitudinally extending lifters, the lifters extending from one rotational flight to another. The lifters may act to break up the ribbon of material generated in the mixing chamber in order to prevent a long continuous ribbon of material being formed within the mixing chamber and surrounding the mixing auger. In various embodiments, the lifters may be longitudinally extending bars. In still further embodiments, the lifters may be curved or angle shaped lifters for lifting and breaking the ribbon of material in order to ensure discontinuity of the formed ribbon. The lifters, upon rotation of the mixing auger, lifts and moves the material over the top peripheral position of the auger thereby ensuring that the mixed components of sand, aggregate and hot liquid AC are properly mixed.

In various embodiments, the lifters may extend from a first flight to a second flight in the longitudinal direction at 180 degree positions relative to the central axis. In still other embodiments, lifters may be provided at 120 degree increments relative to the central auger axis. In various embodiments, the individual lifters may be designed not to extend outside the outer periphery of the individual flights and the flights may be L-shaped or having surfaces at about 90 degree angles of each other.

Clearance may be provided in various embodiments below each of the individual flights within the mixing chamber and the mixing trough in order to allow for the plurality of sized aggregate component elements transported from the storage bins. Adequate clearance must allow for proper rotation of the individual flights within the mixing chamber. Additionally, the mixing chamber may be sized appropriately to ensure proper residence time of the mixture.

In some embodiments, positioned above the mixing auger and within the mixing chamber are a first and a second heater. The heaters may be provided in order to raise the temperature and maintain temperature of the component elements within the mixing chamber to approximately 350 to 450 degrees Celsius. The heaters may be diesel heaters controlled by the PLC which is provided with internal temperature and feedback information regarding the mixing chamber environmental characteristics. Various known type heater elements may be utilized in order to maintain an elevated temperature and environment within the mixing chamber and around the mixing auger.

Concurrently with the heater systems may be positioned a sprayer for one of the liquid AC lines. A liquid bitumen line may be fed by a pump which conveys the liquid AC from the AC tank reservoir into the mixing chamber. The pump and sprayer nozzle in the mixing chamber for the liquid AC may provide the liquid bitumen into the aggregate and sand combination mix within the mixing chamber at a predefined rate depending upon the appropriate recipe selected by the user. The PLC appropriately controls both, among many parameters and operational characteristics, the pump flow rate for the liquid bitumen, temperature for the heaters, rotational speed of the mixing auger and conveyor speed of the elevator, conveyors and rotational speed of the mixing auger in order to properly combine the element to form the pre-selected type of asphalt.

In various embodiments, first and second heaters may be provided and positioned substantially adjacent to a first liquid AC sprayer which is adjacent to a deposit area of the materials into the mixing trough. Such heaters may be diesel heaters.

In embodiments, the mixing chamber extending longitudinally along the mobile system may have a cover in order to retain a predetermined volume of material and air in the mixing chamber and around the mixing auger. The mixing chamber thereby may be fully enclosed within the mixing trough. Heated gases may then flow from the burners towards the exit in the mixing chamber. Elevated temperatures may be maintained within the mixing chamber by virtue of the lid and further by providing insulation surrounding the mixing chamber. The mixing chamber design is such that heated air from the dual burners extends, in many embodiments, along the entire mixing chamber. By covering the mixing chamber with an insulated cover, elevated temperatures may be maintained. In some embodiments, a blower may be maintained in an opposing end of the burner positioning in order to maintain proper air circulation within the covered mixing chamber. Secondary blowers may be utilized to control dust and other particulate material.

At the first end of the trailer system described herein and in the present embodiment, a mounting platform extends along an end portion of the storage bins as well as the mixing chamber. This mounting platform contains the elevators which raises the materials from the conveyor belts to the mixing chamber. First, second and third bin conveyors or drag chains deposit material to an elevator transfer or staging area wherein the component materials are transported to the mixing chamber. As described, the present embodiment incorporates the utilization of a first, second and third conveyor to move appropriate aggregate material and sand to the elevator transfer area. The aggregate material may be a course aggregate, a fine aggregate or variations as required by a particular asphalt recipe. The conveyor motors which drive each of the individual conveyors may be placed or adjacent to the elevator staging area. The materials may be deposited from each of the individual conveyors into the elevator buckets so that they may be appropriately transitioned to the upper mixing chamber.

As depicted, the mechanical supporting harness provides adequate support at the end of the trailer for each of the conveyor motor drives. Additionally positioned on the mechanical supporting harness and adjacent to the elevators is the primary drive for the mixing auger.

As described, the mixing auger extends longitudinally through the mixing chamber. At one end of the mixing chamber which, in the one embodiment is positioned adjacent to the mechanical supporting harness, the motor drive for the mixing auger is mounted. The motor drive is supported in a vertically adjustable floating relationship on the end plate of the mixing chamber so that it may rise and lower according to the component materials contained within the mixing chamber. The primary motor drive for the mixing auger is controlled by the PLC and is driven with the goal of rotating the auger and maintaining the proper mix of material within the mixing chamber thereby ensuring adequate residence time of the component material for creation of the particular recipe asphalt. The auger drive motor and hence the auger may therefore float within the mixing chamber which, in one of various embodiments is depicted as a U-shaped trough with divergent side walls. The end plate of the mixing chamber may have an oblong or non-ovalized aperture for receiving the auger motor drive shaft such that the auger motor when mounted according to the auger motor mounting system described, may move relative to the mixing chamber. Such vertical movement may be necessary for allowance of the auger to rise over expanded material contents within the mixing chamber or also allow for vertical repositioning of the auger and motor due to thermal expansion of the component elements. At the opposing end of the mixing chamber, a similar bearing assembly may be positioned to hold the opposite end of the auger on a mounting plate and within an oblong aperture such that the entire auger and associated drive shaft may move vertically within the aperture and therefore within the mixing chamber.

The mixing chamber may have, in various embodiments, a U-shaped construction with divergent side walls and a longitudinally extending support span. The longitudinally extending supports may interface in a keyed type relationship with the mixing chamber support structure. The mixing chamber supports may have a plurality of Y-shaped support members which received the mixing chamber. The Y-shaped elements receiving the mixing chamber may match the divergent sidewall angles of the mixing chamber and may have a lower keyed notch for receiving a flange of the support span of the mixing chamber. Therefore, the mixing chamber rests within the mixing chamber support structure but is not permanently affixed or directly retained thereto allowing the mixing chamber to float freely within the mixing chamber support structure. The mixing chamber support span adequately supports the mixing chamber within the keyed notches thereby preventing rotational movement of the chamber within the mixing chamber support structure while also allowing vertical expansion along the individual ribs which extend along an exterior periphery of the walls of the mixing chamber. Thus, due to extensive heating of the elements of the components within the mixing system and from the application of extreme heat by the dual burners, the mixing chamber may expand within the mixing chamber support structure both longitudinally and vertically without rupturing any inter-connections therewith. Thus, the mixing chamber floats freely within the mixing chamber support structure to allow for the thermal expansion of the chamber.

The mixing chamber support structure may as well be supported in a floating arrangement with the remainder of the trailer to allow for vertical and horizontal expansion of the various joints. Thus, supports for the mixing chamber support structure may allow for longitudinal movement due to thermal expansion of the support structure. In various embodiments, such retention of the mixing chamber support structure may be positioned opposite the elevator staging area. Such capabilities may be provided for by anchoring of the mixing chamber support structure to the remainder of the trailer from elongated slots which allow for longitudinal movement cause due to thermal expansion.

Various aspects and embodiments will be further described herein and are considered to be explanatory only and not limiting. Specific structure provided to explain multiple features of the mobile asphalt production machine described may be combined with or without other structures set forth and no specific embodiment element set forth is necessarily required to be combined with other structures.

Turning to FIG. 1, the mobile asphalt production machine 10 described herein is constructed of a plurality of aggregate material bins 21 and 22 which feed material to an elevator system 30. Generally speaking, when viewing both FIG. 1 and FIG. 2, the aggregate material contained within bin 21 or bin 22 may be combined individually with fines material or sand contained within bin 23. Bin conveyors or drag chains 41, 42, 43, shown variously in the figures and particularly in FIG. 5, bring forward the selected aggregate material from either bin 21 or bin 22 in combination with the fines material from bin 23 forward to the elevator/conveyor transfer station 36. Such material may be deposited within a drawer 34 prior to being transported by individual buckets 32 of the elevator system 30.

Figure 4:
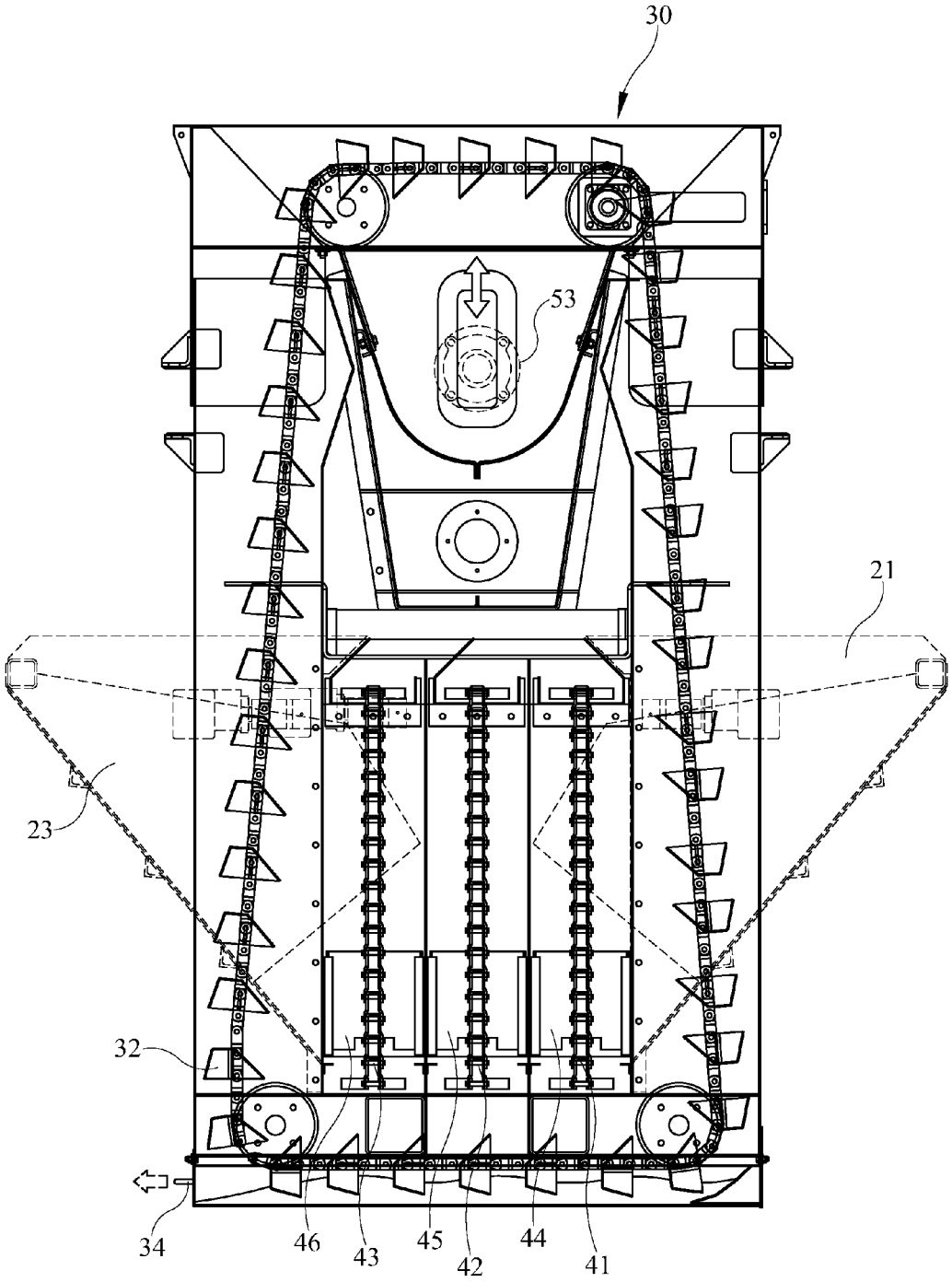
FIG. 4 is a rear view of the various mechanical elements for transporting the material for the plurality of storage bins to the mixing trough for the mobile asphalt concrete production machine of FIG. 1.

Control of the individual bin conveyors or drag chains, 41, 42, 43 as well as the appropriate gates 44, 45, 46 shown in FIG. 4, allows for the appropriate mix of material to be transported from the transfer station 36 to the mixing system 50. Once transported to the mixing trough 51, mixing augers 54, 56, contained within the mixing trough mix the material with liquid bitumen injected into the mixing trough at various points and combined with high heat from diesel heaters 59, to properly mix the material and create asphalt concrete for dispensing through the dispenser 52. A programmable logic controller 70 may control the gates, drag chain speed, elevator speed, as well as auger rotation and heat injected by heater burner 59 in order to create proper residence time within the mixing system 50 for the ingredient material for the requested asphalt recipe.

Figure 6:
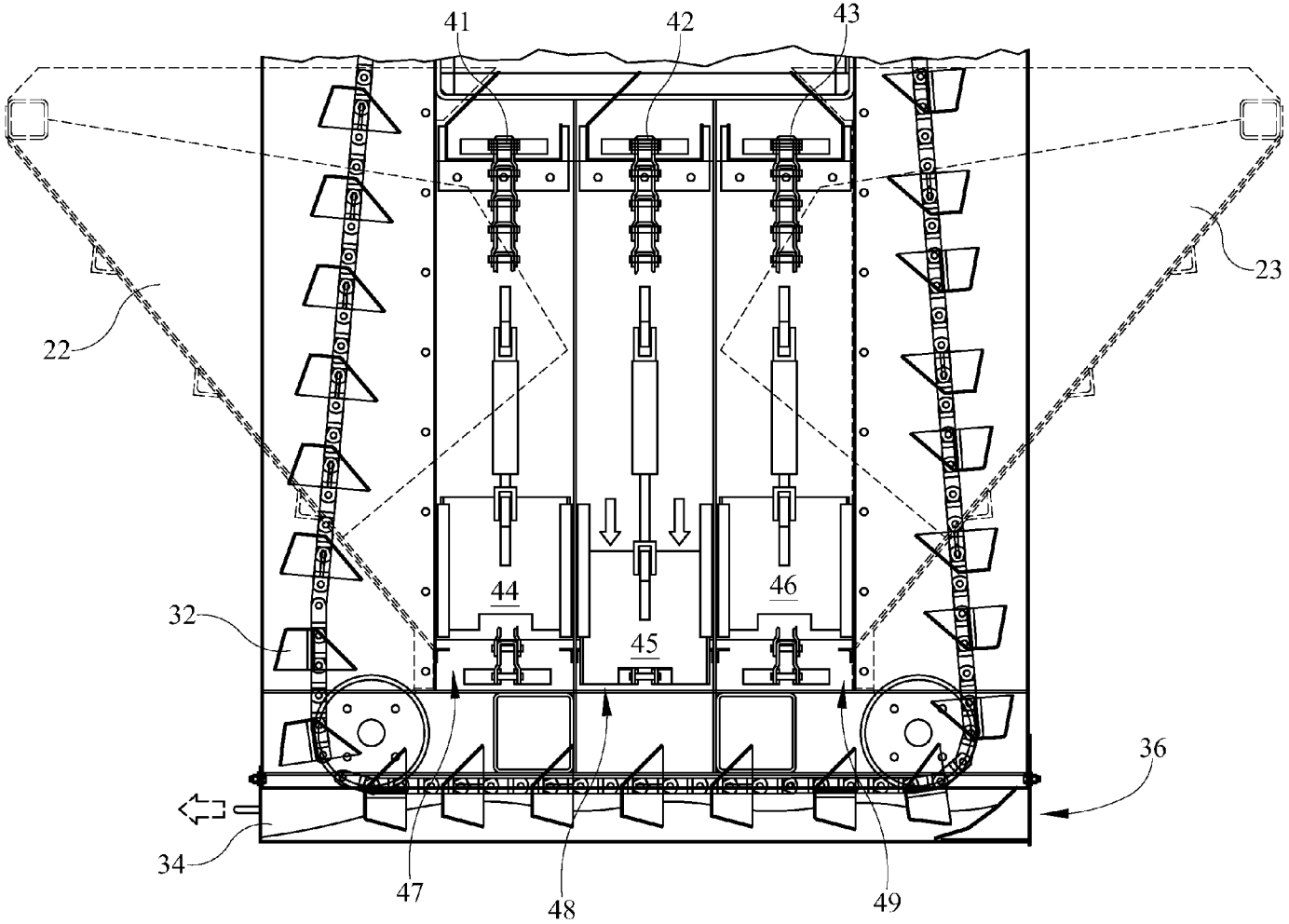
FIG. 6 is a front view of portions of the transport structure for transporting the material from the storage bins to the mixing trough of the mobile asphalt production machine of FIG. 1.

Various asphalt types require individualize aggregate materials. These individual aggregate materials can be contained within the aggregate bins 21, 22 which typically may contain either ⅜ inch size aggregates or ¾ inch size aggregate for creation of wearing surface asphalt concrete or base course asphalt concrete. Depending upon the ingredient selected at the programmable logic controller 70, appropriate aggregate may be selected from either bin 21, 22 and combined with the fines or sand material contained within bin 23 at the transfer station 36. Positioned along a lower portion of each bin 21, 22, 23 is an aperture for dispensing of material into a bin chute 47, 48, 49, see FIG. 6, wherein each of the material has an individual bin chute for advancement of the material to the transfer station. Gates may be positioned at the end of each individual bin chute, gates 44, 45, 46 actuatable by hydraulic pistons or rams to open and close the gate for dispensing of the material into the transfer station. Drag chains or conveyors 41, 42, 43 may be controlled by the PLC 70 at the appropriate speed for the ingredient ratio necessary for the appropriate recipe. As shown in the various figures, drag chains 41, 42 and 43 may extend partially or coextensive with the entire length of the mobile apparatus in order to properly advance material deposited from the bins into the bin chute system.

Storage bins 21, 22 and 23 can be positioned along the flat bed truck or other mobile device 20 depicted within the figures. Apertures may also be placed within the lower portion of the bins to feed the material contained within the bins into each individual bin chute. Motors 37, 38 and 39 may drive the drag chains positioned in the individual chutes 47, 48 and 49 in order to convey the individual material forward to the transfer station 36 depicted in the various. The controller 70 may properly control the amount of the material dispensed from the bins into the transfer station by controlling both the speed of the drag chains as well as the positioning of the dispensing gates 44, 45 and 46.

The individual recipes set forth for the asphalt concrete may depend upon mutually exclusive sized aggregate material to be mixed with the fines or sand material. Change over from a first aggregate bin 21 to a second aggregate bin 22 may be accomplished in a ready fashion but requires a removal of any material left within the transfer station 36 and other areas. As a result, transfer station 36 may include a removable drawer 34 which may be pulled away from the transfer station and emptied out and cleaned by the operator. The drawer may contain a significant amount of mixed aggregate and sand for transport to the mixing system. The drawer 34 may have a first end wall and a first and second side wall with an opposing end wall left removed so that the drawer may be pulled away from the transfer station past each of the individual buckets 32 of the elevator system 30. The drawer 34 as shown in the figures may be completely removed or partially removed or may be hinged to provide access for removal and cleaning by the operator. Multiple options for providing a removable drawer may be utilized and are deemed to fall within the teachings of the specification and disclosure hereof.

Elevator system 30 shown in the figures is driven by elevator motor 33 which rotatably affixes to the drive chains and to the plurality of elevator buckets 32. Each of the buckets rotates around in circular fashion at one end of the asphalt production machine and effectively scoops material by each individual elevator bucket 32 from the transfer station 36 and drawer the material deposited by drag chains 41 or 42 in combination with fines material brought forward by drag chain 43. Elevator buckets 32 lift material at the transfer station and deposit individual buckets into the mixing trough 51 at a first end thereof to be adequately combined and mixed within the mixing trough and mixing system 50. Each of the individualized buckets 32 are rotatably affixed to the elevator chains for the elevator system. Thus, each bucket may rotate within the first and second chains of the elevator to deposit material into the mixing trough at a first end of the mixing trough 51. Elevator motor 33 may similarly be controlled by programmable logic controller 70.

While a first and a second aggregate bin 21, 22 is depicted herein, other embodiments may include a third aggregate bin for a combination of material with the sand material contained within bin 23. Additional bin chutes may be combined with bin conveyors or drag chains to transport material from a location adjacent the additional or added bins forward to the transfer station 36 as necessary. The selection of a first and second aggregate bin 21, 23 is included herewith for exemplary purposes and is not deemed to be limiting of the various features and elements disclosed.

Figure 2:
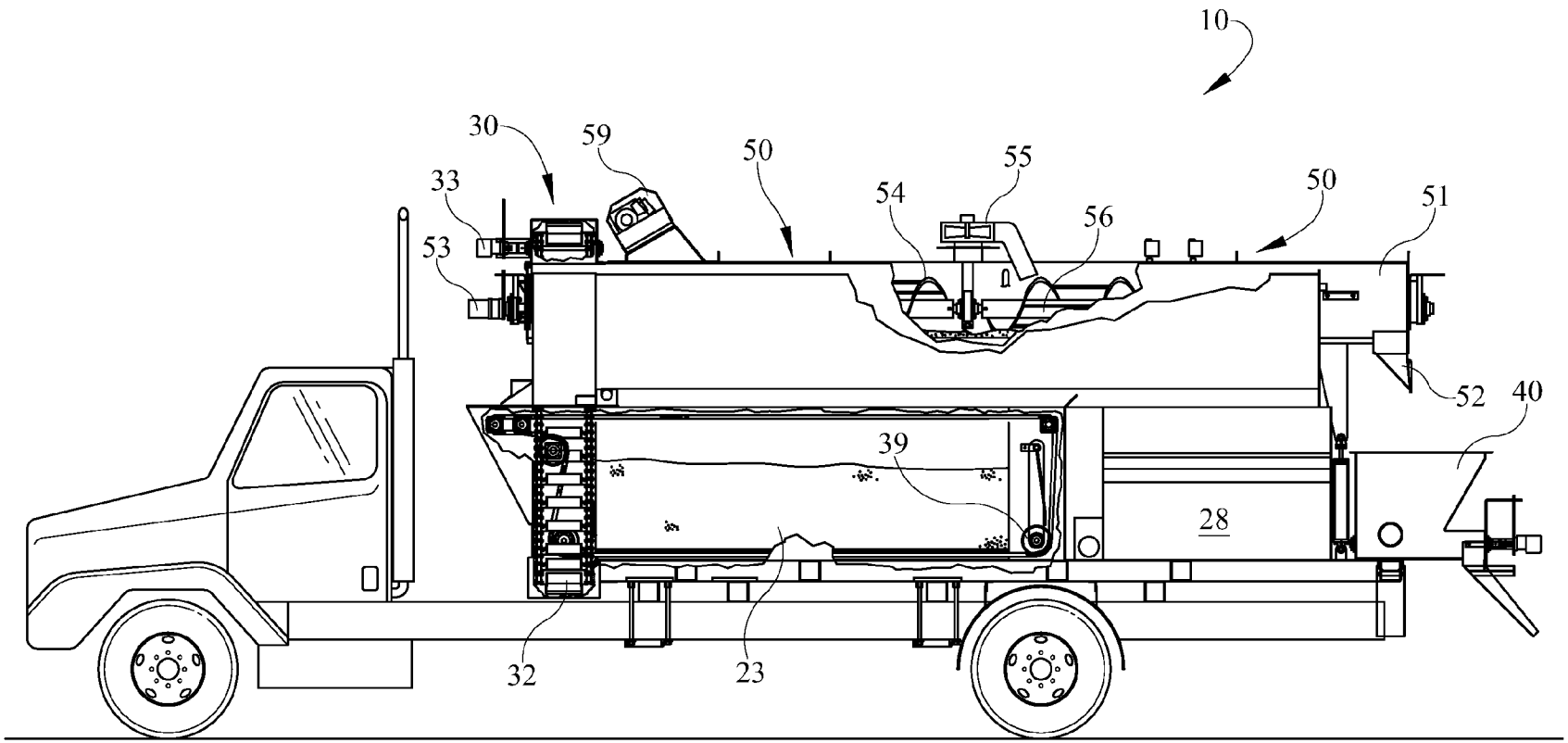
FIG. 2 is an opposite side view of the mobile asphalt concrete production machine of FIG. 1.

In addition to the first, second and third storage bins shown in FIG. 1 and FIG. 2, a liquid bitumen tank 28 may also be disposed along a side of the truck 20 for the mobile machine 10. The liquid bitumen tank 28 may include a diesel fired or oil fired burner and combustion chamber for melting of solid bitumen and for maintenance of high temperature within the bitumen tank reservoir so that the liquid bitumen may be properly dispensed within the mixing system 50 and in the mixing trough 51. A plurality of injectors may be provided within the mixing trough for injection of the liquid high temperature bitumen into the mixing trough 51 at various locations and the pumps necessary for feeding of the liquid bitumen from the storage tank 28 to the various injection nozzles may be individualized and controlled by the controller 70 as necessary for proper residence time within the mixing trough, as well as in response to the requested recipe and needed aggregate material.

Figure 3:
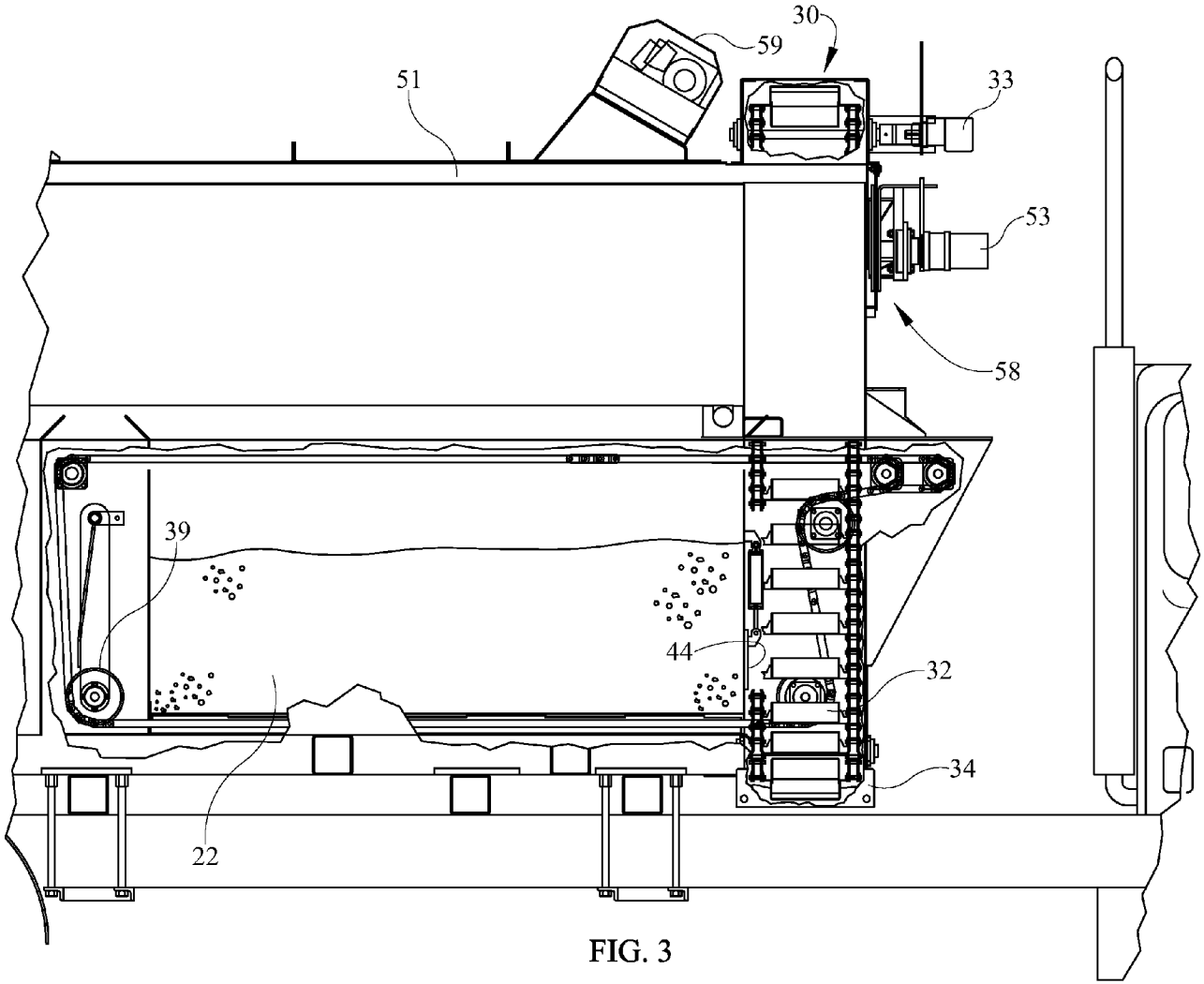
FIG. 3 is a side sectional view of the mobile asphalt concrete production machine of FIG. 1 wherein one aggregate bin and the transfer station and elevator system is disclosed among other items.

As shown in FIG. 3, the mixing system 50 may include a mixing trough 51, as well as high temperature heaters or burners 59 positioned directly above the mixing system 50 for injection of high temperature combustibles into the mixing trough. Material deposited at the elevator depositing area at the first end of the mixing trough may be advanced forward through the trough 51 by the mixing augers 54, 56. The mixing augers 54, 56 may be rotated by mixing auger motor 53 mounted to a first end wall 26 of the mixing trough by virtue of a floating motor mount 58.

Due to the variant size of the aggregate material fed into the mixing trough, the mixing augers 54, 56 may require vertical mobility within the trough. Thus, in some embodiments an elongated slot 27 positioned on the end wall 26 of the mixing trough allows vertical adjustment and mobility of the auger motor drive shaft. Such vertical mobility of the auger motor drive shaft and the individual mixing augers improves the performance of the mixing by allowing the augers to rise based upon the variant diameter of aggregate material deposited within the mixing trough. As a result, an auger floating motor mount 58 has been implemented to support the auger motor 53 on the mixing trough end wall 26 to allow such vertical adjustability dependent upon the size of the aggregate material deposited within the mixing trough 51.

Figure 11:
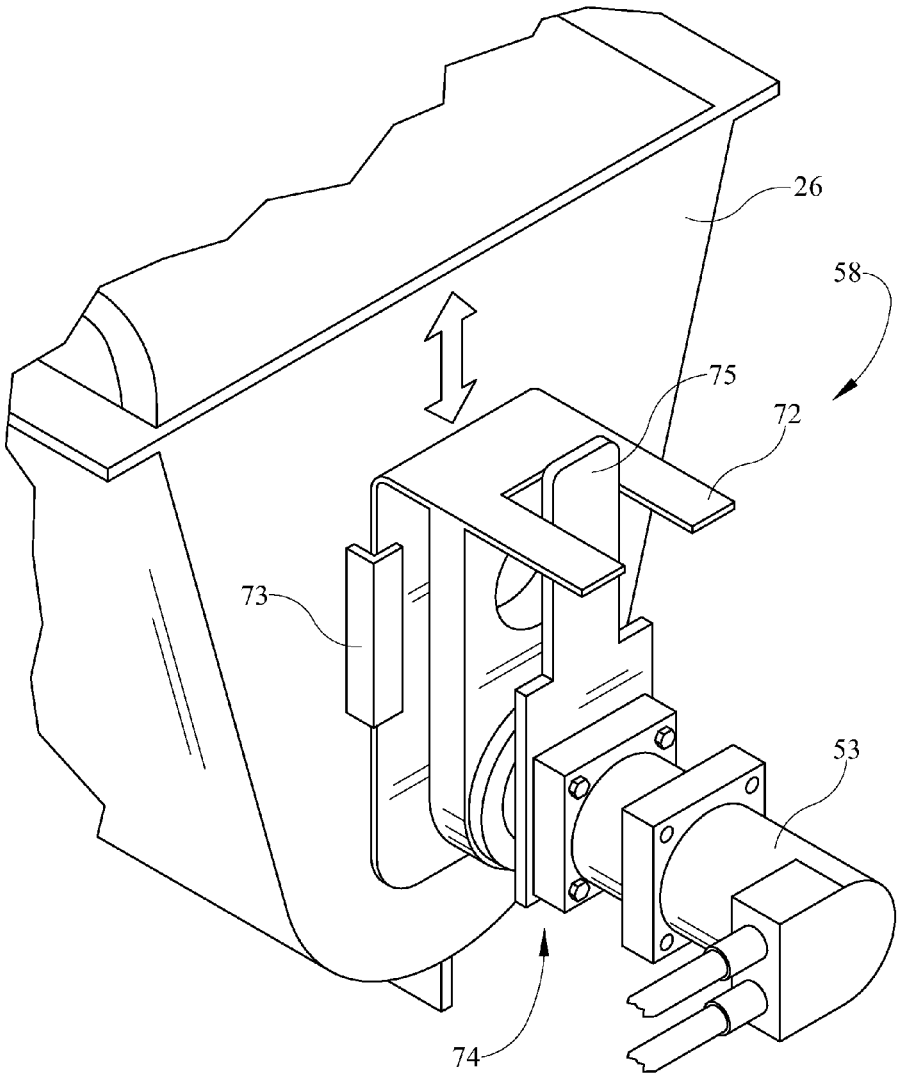
FIG. 11 is an upper perspective view of the floating motor mount for the auger motor depicted in FIG. 10.

As shown in FIG. 11, the auger motor 53 may be connected to an end bearing auger support 74 which includes a torque arm 75 restrained within an L-shaped header plate 72. The L-shaped header plate may rise vertically and adjust to the material contained within the mixing trough by virtue of the header plate bracket 73. Torch arm 75 restrains the rotational mobility of the auger motor 53 by virtue of the first and second arms of the L-shaped header plate depicted in FIG. 11. Header plate bracket 73 positioned on both sides of the header plate 72 allow the header plate and thus the auger motor and auger drive shaft to move vertically relative to the mixing trough and the mixing trough end wall 26.

The vertical adjustability of the auger drive shaft allows close tolerance of the auger to be utilized in order to fully engage various size materials and ensure the larger materials are cleared out by the auger motion when changeovers to different mixes and size aggregates are required. This is accomplished by the auger moving up and away from the trough providing additional clearance in the event of larger aggregate clearance requirements.

Figure 8:
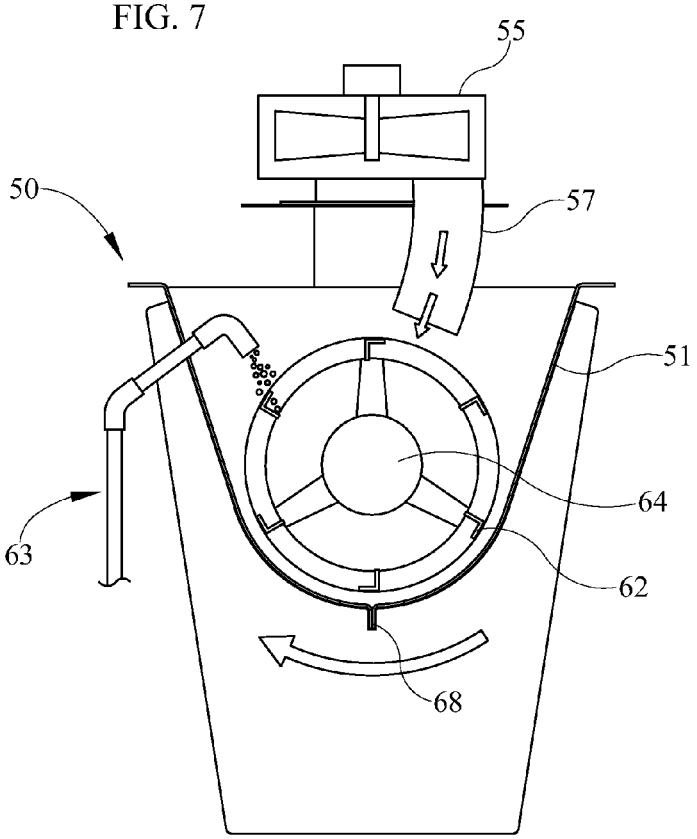
FIG. 8 is a sectional end view of the mixing trough for the mobile asphalt concrete production machine of FIG. 1.

Mixing augers 54, 56 work in conjunction to advance a ribbon of material forward through the mixing trough by virtue of the standard auger ribbon motion. In order to prevent a unified ribbon on material to extend downward through the mixing trough 51, a plurality of longitudinally extending lifters 62 shown in FIG. 8 are positioned at varying locations on the mixing augers 54, 56. The lifters or flights 62 may be a plurality of evenly spaced lifters around the periphery of the auger. The flights 62 or lifters run parallel to the direction of the material flow within the mixing trough and extend the full length between the auger flighting set to a distance between zero and ¼ inch set back from the outer contact edge of the auger flighting. These L-shaped lifters or flights vary the retention time for the heating and mixing of the auger by interrupting normal auger advancement of the material contained within the mixing trough. The lifters 62 retained on the exterior of the auger shaft 64 collect, lift and retain material until an optimum release point is reached in order to appropriately retain material within the mixing trough for heat retention and transfer. The augers may be positioned at a multiple of radial positions as shown in order to release the aggregate material and fines at various points within the auger rotation. Such position of the L-shaped lifters or flights 62 may provide a complete veil of aggregate within the auger thereby promoting maximum heat exchange while also separating, breaking up and interrupting the continuous ribbon of material formed by the mixing action of the auger.

In some embodiments, a first and a second mixing auger 54, 56 are depicted. The first and second mixing auger are connected at a central location within the mixing trough by virtue of a ball bearing support 60 which allows the auger shafts to be discontinuous and vertically repositionable in order to adjust to aggregate size and other operational requirements. Drive shaft 64 may vertically reposition as a result of the variant size aggregate material mentioned herein and as a result of the auger motor mounting system 58 which allows for vertical adjustment dependent upon the content and material within the mixing trough.

While a plurality and specified number of L-shaped lifters are positioned extending between the individual auger flights, those of ordinary skill in the art reading the disclosure herein will understand that modification of the lifters may be accomplished and achieve the same result of lifting material in order to disrupt the ribbon formed by the auger, increase mixing capability and separate aggregate material from the main material flow in order to improve heat exchange from the primary burner 59. Thus, in the various embodiments depicted, modification of a single auger as opposed to a first and second auger shown in the figures or repositioning of the lifters or shape of the lifters may be accomplished and achieve the same functionality and result and is considered to fall within the teachings hereof.

Figure 7:
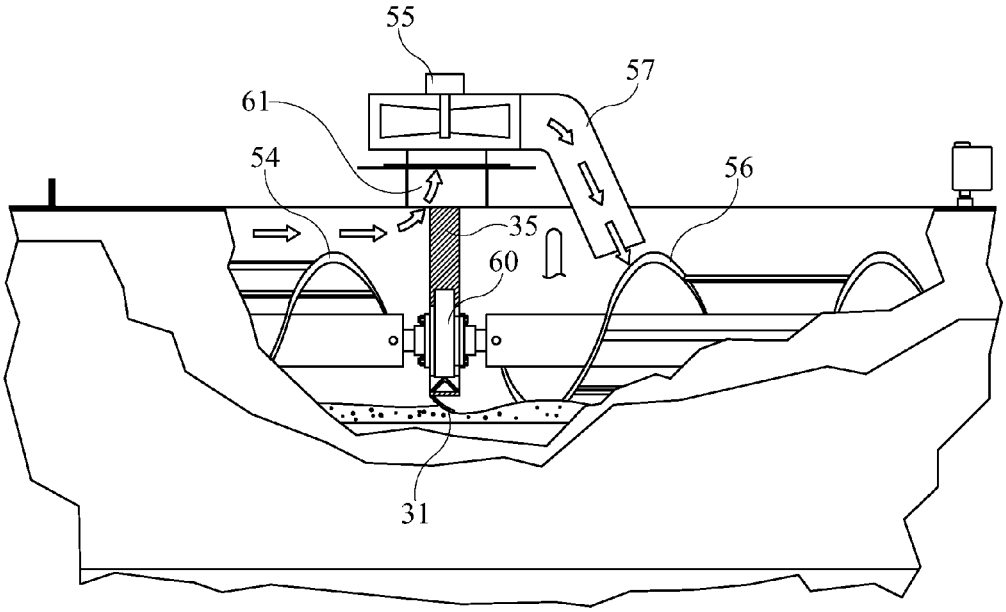
FIG. 7 is a partial cut away view of the mixing trough and mixing augers for the mobile asphalt concrete production machine of FIG. 1.
Figure 10:
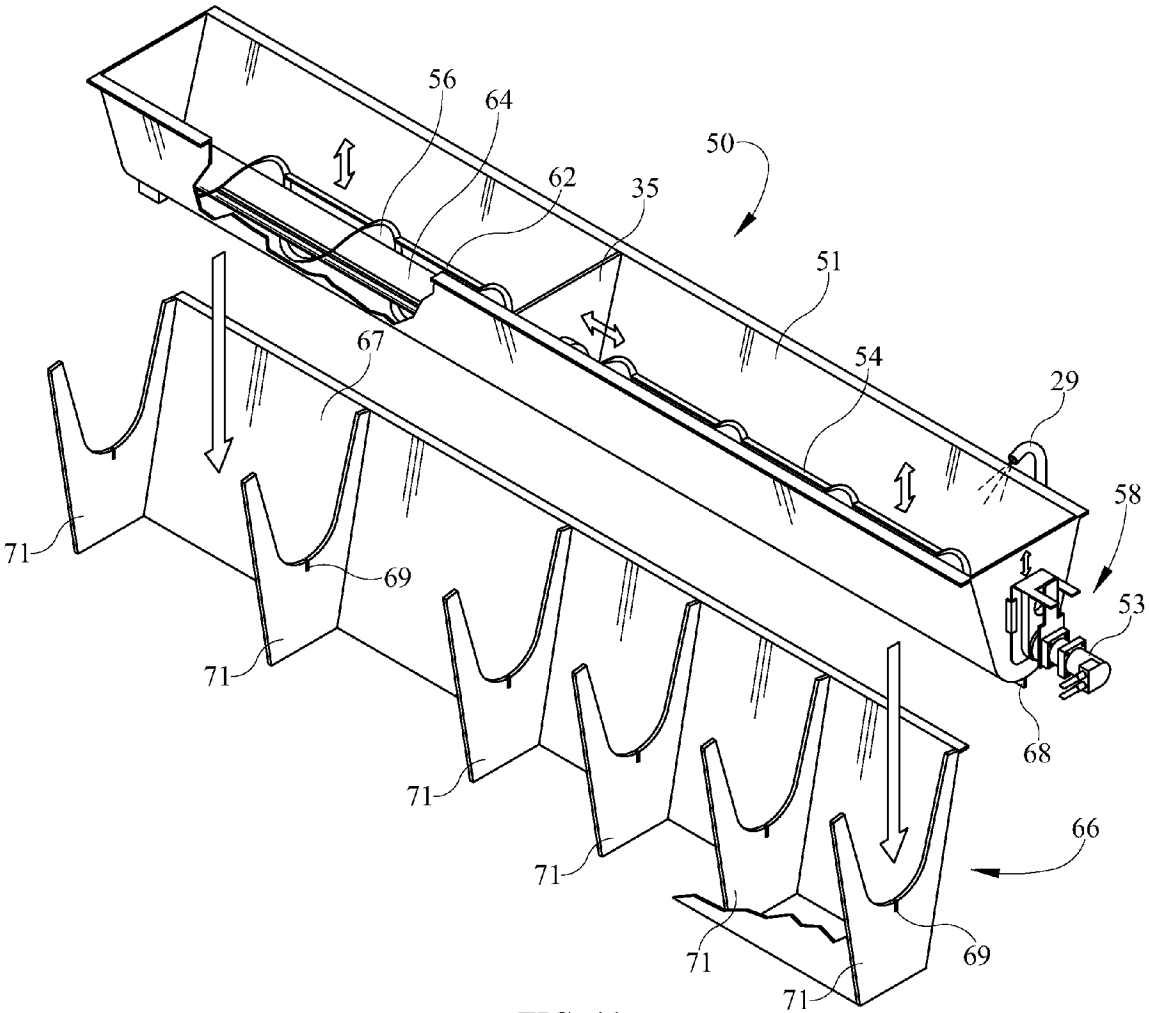
FIG. 10 is an upper perspective view of the mixing trough and trough support structure for the mobile asphalt concrete production machine of FIG. 1.

Liquid bitumen or AC may be injected into the mixing trough at various locations. As shown in FIGS. 7 and 10, injection nozzle 29, 63 may be utilized to provide liquid AC into the mixing chamber in order to adequately allow adhesion of all of the ingredients together to create the desired asphalt concrete. While two nozzles are depicted within the figures, additional nozzles or a singular nozzle may be utilized in order to maximize use of the liquid bitumen in the ingredients necessary to create the requested asphalt concrete. The nozzles and other structure in some embodiments and just a bitumen supply line to the trough may constitute alternative constructions of a liquid bitumen injection assembly for supplying liquid bitumen to the interior of the trough or to the aggregate at other various locations.

Also shown in the figures is a dust retention and reduction system. Airflow fan 55 may be positioned at the center portion of the mixing trough and include a fan intake 61 at a first half of the mixing trough and exhaust port 57. The entirety of the mixing trough 51 may be separated by a baffle 35 at or adjacent to a central position of the mixing trough. The baffle may effectively divide the mixing trough into a first mixing trough section and a second mixing trough section thus preventing dust and other material in the first mixing trough section to advance forward to the second mixing trough section.

In the particulate reduction system depicted, air from the first mixing trough section may be circulated by fan 55 and deposited into the second mixing trough section at a position adjacent to a liquid bitumen injector 63 to thereby adhere or bind to the dust or other particular material exiting the exhaust chute 57 into the second trough section. As significant amounts of dust and other particular material may be created during the initial mixing action at the first end of a mixing trough, such dust from the particulate material may be collected and recycled back into the ribbon of material formed by the mixing augers. Such recycling may be further effectuated by combining the dust or particular material with the liquid bitumen at the injector nozzle 63, the injector nozzle 63 providing a binding agent to bind with the dust or particular material and allow the material to recombine with the remaining aggregate and fines.

As depicted within the figures, the baffle 35 may include a baffle flange 31 at a lower edge thereof which allows advancement of the combined aggregate and fines material below the baffle to advance towards the end of the mixing trough. As shown, the baffle and flange combination effectively separate and allow for capturing of the dust such that it may be recombined through binding with the liquid AC and actuation of the second auger 56 in the second mixing portion of the mixing trough.

In various embodiments, the dust collection system may or may not be utilized in order to effectively create the required asphalt concrete recipe desired.

In further embodiments, a continuous mixing auger may be utilized without a mid-point baffle, bearing support or other structure. Alternatively, a baffle may be positioned anywhere within the interior of the trough in order to separate and isolate sections of the trough in order to improve dust collection. Such recycling structure requires no maintenance, minimal cost in production and importantly allows the fine particulate material to be captured in the mix where it is needed as filler in order to strengthen the mix. Further, such structure allows for the fine particulate material to be captured consistently. In a conventional fixed location plant, a bag-house method is implemented which is expensive to build and maintain, the dust is collected, conveyed, stored and again conveyed & metered back into the mix to make a strong mix. This becomes a major cost in the plants. By automatically implementing a recycling system as shown, reduced lost, capture of dust to the environment and other benefits are achieved.

It is also understood that a baffle flange may be replaced with other structure allowing the aggregate and fines material to pass while also effectively preventing passage of a substantial or partial amount of the airborne particulate material within the mixing trough. All of such modifications are considered to fall within the teachings hereof as one of ordinary skill will be able to make such modifications after review of the present disclosure.

The controller 70 can adjust varying parameters of moisture content, heat, air recirculation, elevator speed, drag conveyor speeds and auger rotations in order to meet predefined types of asphalt concrete to be manufactures by the mobile asphalt concrete machine. Initial ratios of aggregate and fines or sand determine the drag conveyor speed and gate status, alternatively opening and closing the appropriate gate 44, 45, while opening gate 46 to admit fines to the transfer station. Measurements may be taken from temperature sensors within mixing system 50 at various points in order to increase or decrease heater 59 on times, as well as air flow fan 55 or air flow from an exhaust fan positioned at an end of the mixing trough. Various environmental measurements can determine the increase of liquid bitumen at injector 29, as well as at secondary injector 63 shown in FIG. 8. Primary injector 29 of the liquid bitumen initiates the mixing process by providing a binding agent for the aggregate and fines material to adequately mix the material within the mixing trough 51 as mixed and disrupted by the auger, auger flights, lifters and other structures. Total residence time can be calculated and appropriately measured and adjusted based upon environmental measurements of temperature and moisture in order to assure that the asphalt concrete is provided sufficient time and exposure to heat in order to create the appropriate blend requested and controlled by the PLC controller 70.

Figure 9:
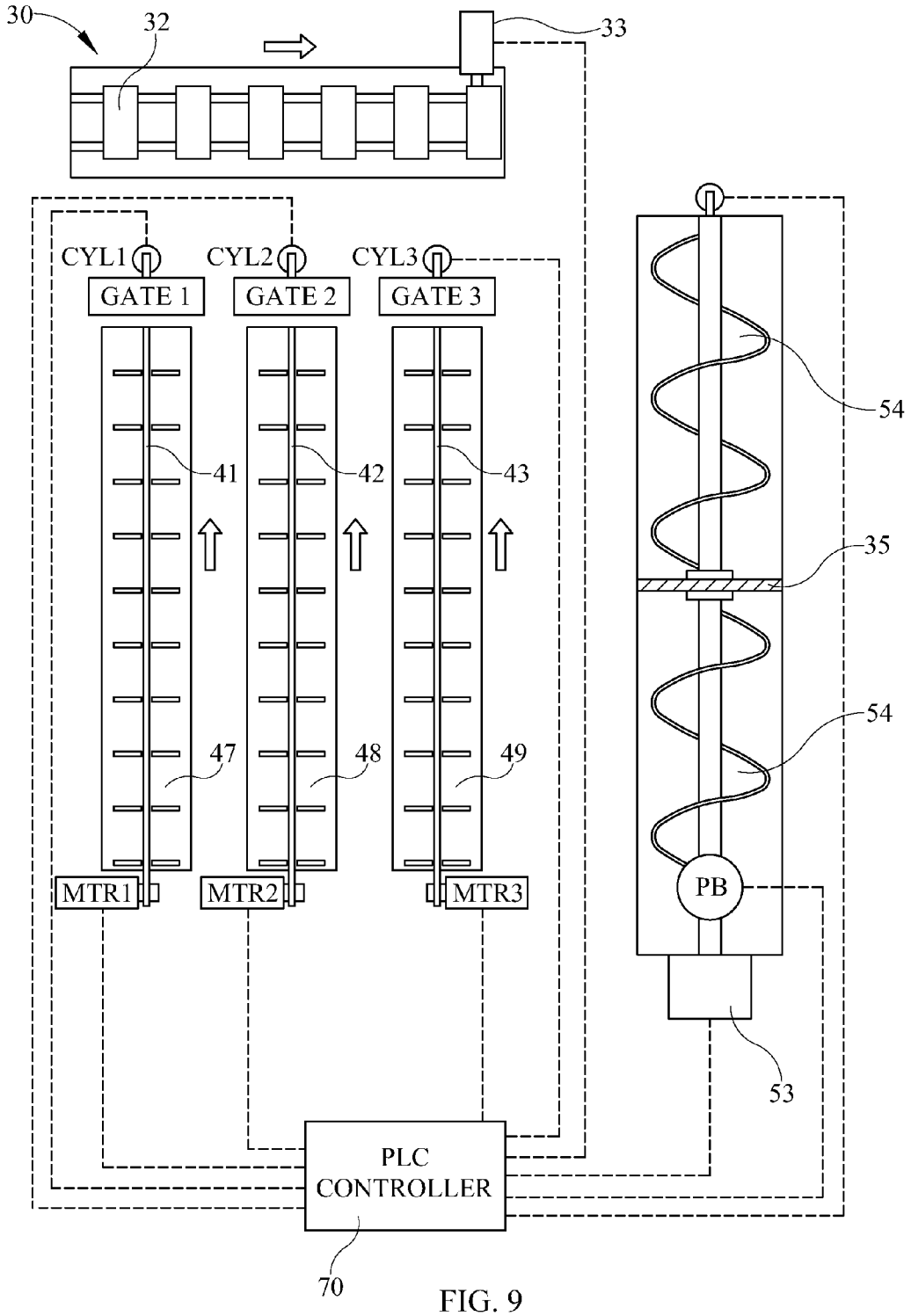
FIG. 9 is a component controller view of the various components of the mobile asphalt concrete production machine of FIG. 1 as integrated to a controller.

Controller 70, shown in FIG. 9, is also operably connected to the various environmental sensors, not shown for purposes of clarity, in order to adequately control the dispensing amounts and ratios, as well as the total residence time within the trough of the various mixtures. The sensors provide feedback of the PLC controller to meet the necessary recipe conditions.

Further, the PLC controller may be directly connected to a combustion chamber at the liquid bitumen tank 28 in order to appropriately melt the solid bitumen contained within the tank or appropriately heat any liquid bitumen contained within the reservoir and then injected into the plurality of nozzles optionally placed at various positions within the mixing trough. Tandem direct burners at the mixing trough can be utilized in order to allow the PLC controller 70 to cycle one burner on and off in order to control the temperature within the mixing trough. The second burner may cycle off upon reaching a preset maximum air temperature within the mixing system 50. When the air temperature within the mixing trough reaches a certain triggering minimum, the burner or burners may cycle back on in order to increase the air temperature. The controller 70 cycles the burners as mentioned upon reaching preset maximum air temperatures based upon the recipe and other environmental conditions. The controller 70 may sense temperature rise rates and adjust aggregate feeds of the material of elevator system 30 accordingly. Increased aggregate volume can reduce temperature within the mixing trough. If minimum pre-determined temperatures for the desired receipt are not reached, the controller may reduce the drag conveyor's rotational speed and then remeasure resident temperature within the mixing trough in order to properly elevate the temperature and meet mixing conditions for the desired asphalt concrete being produced.

By integrating the controller 70 with automatic control of the drag chains 41,42 and 43, as well as with the elevator system 30 and the rotational speeds of auger 54, 56, the controller may then properly combine liquid bitumen at the various locations and at desired concentrations while also maintaining desired temperatures within the mixing trough 51 to insure proper environmental conditions for the desired recipe of asphalt concrete while maintaining accurate control of the conditions within the trough. Such conditional sensors include hydraulic motor feedbacks from shaft rotations of the mixing augers in order to identify the exact quantity of shaft rotations and RPMs necessary and compare such measurements to predefined variables. Augers 54, 56 pressure may also be monitored in order to indicate when the auger has aggregate introduced by the elevator system 30 and when the mixing system or trough is empty. Thus, controller 70 is monitoring the position of the aggregate and fines within the system and introducing the liquid bitumen at the injector nozzle by control of the various pumps at the liquid bitumen storage tank 28 at the correct time by combining such information with the auger shaft revolutions which may be continuously monitored. The exhaust fan speeds at both a dust recapturing fan 55, as well as an additional exhaust fan positioned at the dispensing end of the mixing trough 51 may be controlled to vary the conditions in the heating and mixing process within the mixing system 50.

The liquid bitumen storage tank 28 may also be controlled by the PLC in order to maintain the temperature above the melting point of 270 degrees Fahrenheit such that it is a viscous liquid which can be pumped throughout the mixing system. The liquid bitumen and storage tank may include bitumen pumps which are fully immersed within the storage tank 28 and driven by a hydraulic motor from outside the tank. The hydraulic motor may be a variable speed motor controlled by a PLC 70 with feedback through a shaft sensor. An intake feeder may be provided in order to insert either liquid or solid bitumen within the storage tank 28 during processing and the PLC controller may maintain the elevated temperatures during operational mixing.

Figure 5:
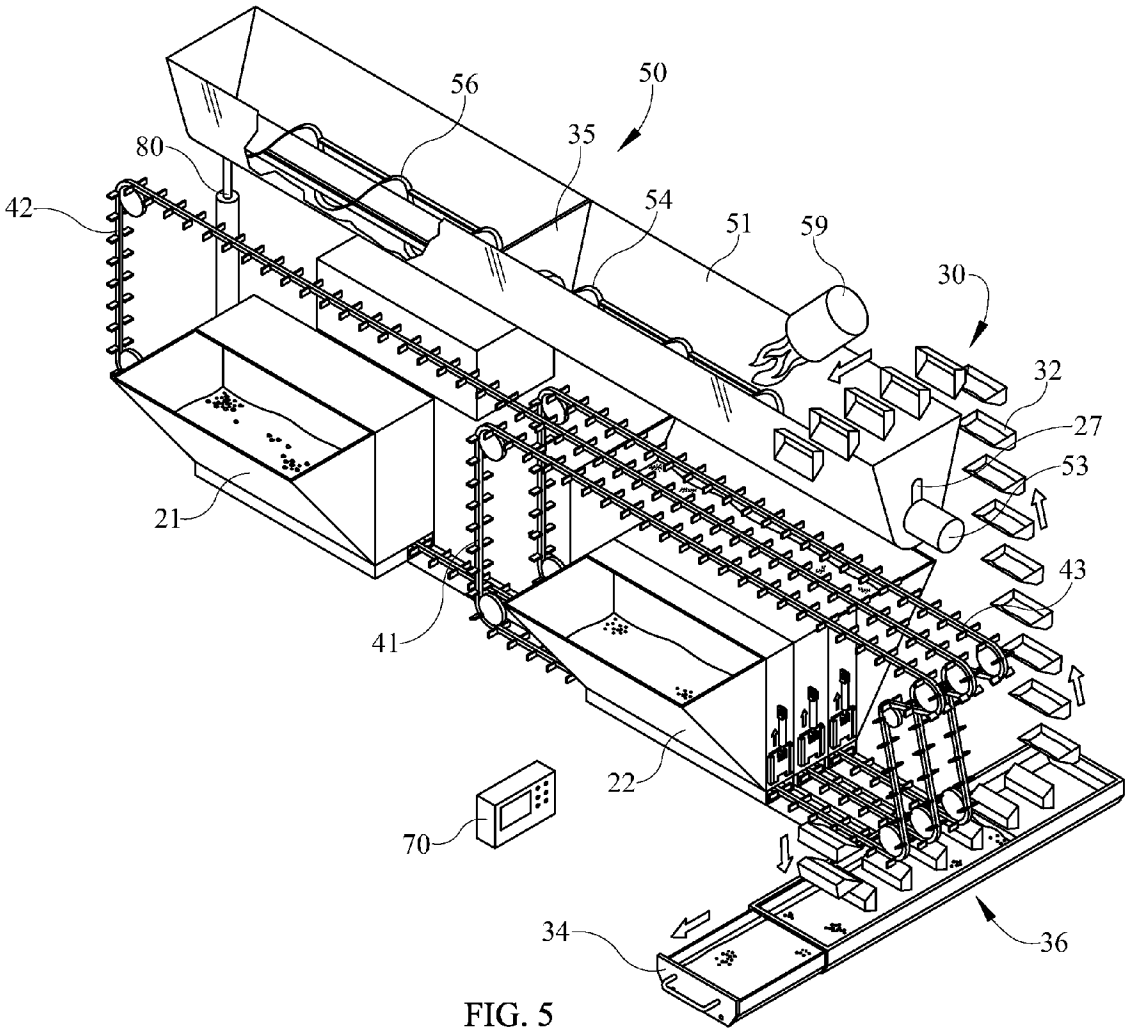
FIG. 5 is a perspective view of selected components of the mobile asphalt concrete production machine of FIG. 1.

Turning to both FIGS. 5 and 10, the mixing system 50 as disclosed herein includes a mixing trough 51 which is allowed to float within a trough support system 66. The mixing trough supports include a plurality of support members 71 which the trough 51 rests. In some embodiments, the trough supports 71 may be a plurality of U-shaped support members which match the divergent side walls of the mixing trough 51. The entire trough 51, supports 71 and other structure which is needed and which forms the support system 66 may be affixed at an end point at the first end of the trough to the tower which extends vertically upwards from the bed portion of the mobile truck or other device 20. Thus, the mixing system can be fixedly attached affixed at one end but allowed to expand within the supports as well as longitudinally along the central axis of the trough, the trough non-fixably retained within the supports 71 except for at positions along one end of the trough. In other embodiments, various combinations of affixation and expansion support connectivity may be included.

In some designs, due to the high temperature fluxuations of the mixing trough 51, sliding connectivity between the trough 51 and the support members 71 is necessary to allow expansion and contraction thereof. Expansion and contraction of welded metals can cause significant damage to the weld and cause the weld to crack or become dysfunctional. The mixing trough 51 may rest within the plurality of support s 71 which allows for expansion and contraction and in which there are no permanent fasteners integrated between the support 71 and the mixing trough 51.

The plurality of supports and trough may be designed to prevent rotation of the mixing trough within the U-shaped supports depicted or within any other supports. Various types of supports may be implemented to effectuate the floating design depicted and described herein. In some examples, the mixing trough may include a downwardly depending trough flange 68. The plurality of supports 71 may include a trough support notch 69 within which the trough flange 68 resides. As a result, torque or other rotational force imposed upon the mixing trough 51, by virtue of the motor 53 or other devices such as the augers 54, 56 does not cause the trough 51 to rotate within the plurality of trough supports 71. Notches 68 formed in the supports 71, also shown in FIG. 8, allow the trough to expand longitudinally within the trough supports in order to allow expansion in various axes when heating and mixing asphalt concrete.

In some designs, the trough may be restrained by the other structures within a plurality o f supports 71 including permanent affixation mechanism. Alternatively, various other configurations for the trough supports 71 may be implemented as long as the mixing trough and trough 51 is positioned and restrained above or in a longitudinal fashion with the mobile asphalt mixing machine.

Substantial rotational pressure imposed upon the mixing trough 51 by the auger motor 53 and by the mixing augers 54, 56, will result in torque being imposed upon the entire mixing trough 51. Flange 68 is restrained within the plurality of notches 69 and will prevent rotational displacement of the mixing trough within the support system. Additionally, such rotational torque imposed by mixing auger motor 53 on the augers and primary shaft 64 can be restrained by virtue of the L-shaped header plate 72 as well which is restrained on the mixing trough end wall 26. The L-shaped header plate contains the end bearing support for the auger. The auger motor shaft is connected to the auger tube by key and screw from the motor shaft end. The housing of the motor is prevented from rotation by torque arm that is retained by the L-shaped header plate.

In various embodiments, a cover may be placed on the open top of the mixing trough 51, the cover, not shown for purposes of clarity of the other structures, may be arcuate or of other design and may include a dual cover which includes a lower cover portion in order to properly enclose the interior area of the mixing trough and mixing system while also including an upper cover, the lower cover and upper covers separated by insulation material to insulate the interior and reduce heat loss during mixing operations. Such covers may extend in the longitudinal direction over the mixing trough 51 from the first end adjacent to the auger motor 53 to the second opposite end. Alternatively, or in addition to, the covers may include an opening for depositing of the aggregate and fines material at the first end of the mixing trough adjacent to the position where elevator buckets 32 deposit ingredients into the mixing system 53. The covers may be integrated into a single cover layer and also may be, in the multiple embodiments disclosed herein, removable so as to provide relatively easy access into the interior of the mixing system 50. Such removability may be hinged connectivity, entire removability or partial removability where a first portion and a second portion of the cover may be separable and hinged or removable relative to the mixing trough. Multiple other designs for a cover may be implemented and are felt to fall within the various teachings as those of ordinary skill in the art having the benefit of this disclosure may modify the various features provided. The mixing trough also may have a cover to create the heated air channel which is concentric to the mixing auger.

An external cowling may also be provided extending longitudinally along the bed of the truck 20 in order to enclose the interior of the mixing system and to cover the necessary hydraulic, electrical, and other fluid connectivity mechanisms required for operation of the mixing system 50.

Elevational position of the mixing trough 51 within the trough support 71 must be maintained in order to keep the asphalt concrete and mix within the trough 51 moving in the proper direction. An elevational adjustment ram 80 may be provided on a portion of the truck 20 which may be directly affixed to the floating trough 51 and/or supports 71. The elevational adjustment ram 80 may raise and lower the elevation differential of the trough 51 relative to the truck or mobile device by plus or minus three degrees or more. Maintaining the elevational position of the mixing trough during production of the asphalt concrete may be provided so that the mixing trough is maintained at approximately zero degrees. If a negative pitch is experienced with regards to the elevational position of the mixing trough, the material in the mixing system may move backwards and overload the auger as the material continues to congregate at or near the first end of the mixing trough. Thus, such negative elevational difference may inhibit transfer of the material down the mixing trough towards the exit dispenser. Alternatively, if a positive elevational difference is experienced with regards to the mixing trough relative to the ground, asphalt concrete being mixed within the trough may move forward too rapidly and not have sufficient residence time for heat transfer and creation of the required recipe of asphalt concrete being mixed. Thus, an elevational measurement device may be positioned on the truck and fed into the controller 70 which may automatically adjust the displacement ram 80 to maintain the mixing trough 51 at a preferred zero degree elevational position from the first end to the second opposite end of the mixing trough and relative to the ground. As also can be seen from the various figures, a dispenser 52 at the second end of the mixing trough may be provided to dispense asphalt concrete mixed within the trough and the mixing system 50 into the storage dispenser 40 within which completed asphalt concrete mixed and heated to the appropriate temperature may be retained and maintained until dispensed through the storage dispenser 40.

In various additional embodiments, the mixing system 50 may be physically separated from the multiple bins and elevator system. As such, the mixing trough 51 and trough support 71 may be provided to mix aggregate concrete with an automatic and portable feeder supplying the materials for mixing. A mixing system 50 may be thus provided having the ability to remotely receive the asphalt materials at a first end, such mixing system detached from the remainder of the structure described. In such a construction, the mixing system may include any combination of auger, mixing trough, vertical adjustability of the augers within the trough, liquid bitumen spray devices, among other aspects. Further, vertical adjustment of the entire mixing trough and/or system may be provided in various embodiments by implementation of an elevational adjustment ram 80 as disclosed. Such a portable mixing trough type system could be readily combined with a separate feed system for a premixed combination of aggregate and sand which would then feed the mixing system and mixing trough at said first end. In some embodiments, such a mobile mixing auger and system structure could be combined with a separate mobile or static feeding system or could be combined with other types of asphalt concrete feeders and the like. Thus, various structures disclosed herein extend to the use of a mobile mixing system having the a detached mixing system structure and no unnecessary limitation is deemed to be imparted upon the interpretation of the teachings or amended claims resulting from the exact combination of the mixing system and other elements of the mobile asphalt mixing machine described in the various embodiments and included in the multiple claims appended hereto.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. Further, the various embodiments depicted herein for the mobile asphalt mixing machine are provided in terms of production of asphalt concrete. However, upon review of the disclosure herein, it is apparent that such combination of various elements may be utilized for production of other materials as well, such as concrete. Thus, inclusion of the environmental conditions for the machinery for the mixing of asphalt concrete is provided for purposes of explanation. No unnecessary limitation therefore should be inferred from such conditions and production method.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A mobile asphalt mixing machine, comprising:

a mobile frame having a fines storage bin with a discharge aperture into a first bin conveyor, said first bin conveyor leading to an elevator transfer area;

a first aggregate storage bin having a discharge aperture into a second bin conveyor, said second bin conveyor leading to said elevator transfer area;

a second aggregate storage bin having a discharge aperture into a third bin conveyor, said third bin conveyor leading to said elevator transfer area;

an elevator conveyor aligned with said elevator transfer area to lift material from said elevator transfer area to a mixing trough;

wherein said mixing trough has a mixing auger extending longitudinally through said mixing trough, said mixing auger forwarding material deposited by said elevator conveyor through said mixing trough and to a mixing trough exit;

a bitumen nozzle adjacent said mixing trough and aligned therewith to deposit liquid bitumen into said mixing trough;

at least one heating device directing heat into said mixing trough;

wherein said mixing trough has a recycling exhaust fan and is partitioned by a baffle into a first portion and a second portion, said first portion having an air intake of said recycling exhaust fan and said second portion having an air exhaust of said recycling exhaust fan.

2. The machine of claim 1 further including a drawer forming at least a portion of said elevator transfer area, said drawer removable for clearing material contained within said elevator transfer area, wherein said drawer forms a substantial portion of said elevator transfer area and receives a plurality of elevator buckets during operation of said machine as said buckets move through said drawer, said drawer sliding outward away from said machine.

3. The machine of claim 2 wherein said drawer is removable from said machine.

4. The machine of claim 1 wherein a logic controller is operably connected to said mixing auger, said elevator conveyor, said at least one heating device and said first, second and third bin conveyor.

5. The machine of claim 4 wherein each of said first, second and third bin conveyors has a gate, said gates operably connected to said logic controller for opening and closing said gates.

6. The machine of claim 5 wherein each of said gates for said respective bin conveyors cover an exit end of each respective bin conveyors at said elevator transfer area.

7. The machine of claim 5 wherein said logic controller operably activates said gates and each of said first, second and third bin conveyor as well as said mixing auger and said elevator conveyor, said logic controller operable to draw material from said fines storage bin and one of said first aggregate storage bin and second aggregate storage bin thereby closing said gate for said other non-activated aggregate storage bin.

8. The machine of claim 1 wherein said mixing auger floats vertically within said mixing trough.

9. The machine of claim 1 wherein said baffle is a plate of said mixing trough.

10. The machine of claim 1 wherein said mixing auger includes a first and second mixing auger.

11. The machine of claim 1 wherein said mixing trough includes a cover.

12. The machine of claim 1 wherein said mixing trough is pivoted between a first angle and a second angle by one or more displacement rams.

13. A mobile asphalt mixing machine, comprising:

a mobile frame having a fines storage bin with a discharge aperture into a first bin conveyor, said first bin conveyor leading to an elevator transfer area;

a first aggregate storage bin having a discharge aperture into a second bin conveyor, said second bin conveyor leading to said elevator transfer area;

a second aggregate storage bin having a discharge aperture into a third bin conveyor, said third bin conveyor leading to said elevator transfer area;

an elevator conveyor aligned with said elevator transfer area to lift material from said elevator transfer area to a mixing trough;

wherein said mixing trough has a mixing auger extending longitudinally through said mixing trough, said mixing auger forwarding material deposited by said elevator conveyor through said mixing trough and to a mixing trough exit;

a bitumen nozzle adjacent said mixing trough and aligned therewith to deposit liquid bitumen into said mixing trough;

at least one heating device directing heat into said mixing trough;

wherein said mixing trough has a cover to create a heated channel, said heated channel including a recycling air intake and air blower to capture particulate matter upstream in said mixing trough and an air exhaust to re-introduce said particulate matter downstream in said mixing trough;

wherein said mixing trough is partitioned by a baffle, said air intake upstream of said baffle and said air exhaust downstream of said baffle.

14. The machine of claim 13 wherein said baffle is a plate of said mixing trough.

15. The machine of claim 14 wherein said plate includes a bearing support.

16. The machine of claim 13 wherein said mixing auger includes a first and second mixing auger.

17. The machine of claim 13 wherein said air blower captures heated air upstream of said baffle and injects it downstream of said baffle.

18. The machine of claim 13 further including a drawer forming at least a portion of said elevator transfer area, said drawer removable for clearing material contained within said elevator transfer area.

* * * * *